United States Patent [19]

McCort

[11] 4,184,643

[45] Jan. 22, 1980

[54] APPARATUS FOR PRODUCING BLOWING WOOL INSULATION FROM GLASS WOOL MAT

[75] Inventor: Ralph E. McCort, Newark, Ohio

[73] Assignee: Owens-Corning Fiberglas Corporation, Toledo, Ohio

[21] Appl. No.: 939,548

[22] Filed: Sep. 5, 1978

[51] Int. Cl.[2] ..... B02C 23/00; B02C 23/30

[52] U.S. Cl. ..... 241/87; 241/143; 241/54; 241/152 A

[58] Field of Search ..... 83/343, 346, 347; 241/51, 54, 60, 87, 144, 143, 142, 141, 139, 152 A

[56] References Cited

U.S. PATENT DOCUMENTS

| | | | |
|---|---|---|---|
| 617,735 | 1/1899 | Godfrey | 241/142 X |
| 1,432,420 | 10/1922 | Sheldon | 83/343 X |
| 2,745,491 | 5/1956 | Sonneborn et al. | 83/347 X |
| 3,627,211 | 12/1971 | Leach | 241/60 X |

*Primary Examiner*—Richard B. Lazarus

*Attorney, Agent, or Firm*—Ronald C. Hudgens; Philip R. Cloutier; Paul J. Rose

[57] ABSTRACT

A pair of gear-driven hollow cutting cylinders, each perforated with square holes to provide a grid of exterior cutting edges extending circumferentially and longitudinally of the cylinder, breaks a glass wool mat fed therebetween into small columns which are pneumatically conveyed from the inside of the cylinders to a conventional bagging machine.

1 Claim, 3 Drawing Figures

APPARATUS FOR PRODUCING BLOWING WOOL INSULATION FROM GLASS WOOL MAT

This invention relates to apparatus for producing blowing wool insulation from glass wool mat, and more particularly to hollow grid-like cutting cylinders through which glass wool mat is forced to break it into small columns for use as blowing wool.

An object of the invention is to provide an improved apparatus for breaking up glass wool mat into small columns for use as blowing wool.

Another object is to provide longer lasting apparatus for such a purpose.

A further object is to provide apparatus for such a purpose, the apparatus being more self-cleaning than former apparatus.

Yet another object is to provide apparatus for such a purpose, the apparatus having greater heat dissipation ability than former apparatus so as to run at a lower temperature when handling a hot mat of freshly made glass wool.

Other objects and advantages will become apparent when the following specification is considered along with the accompanying drawings in which.

Figure 1:
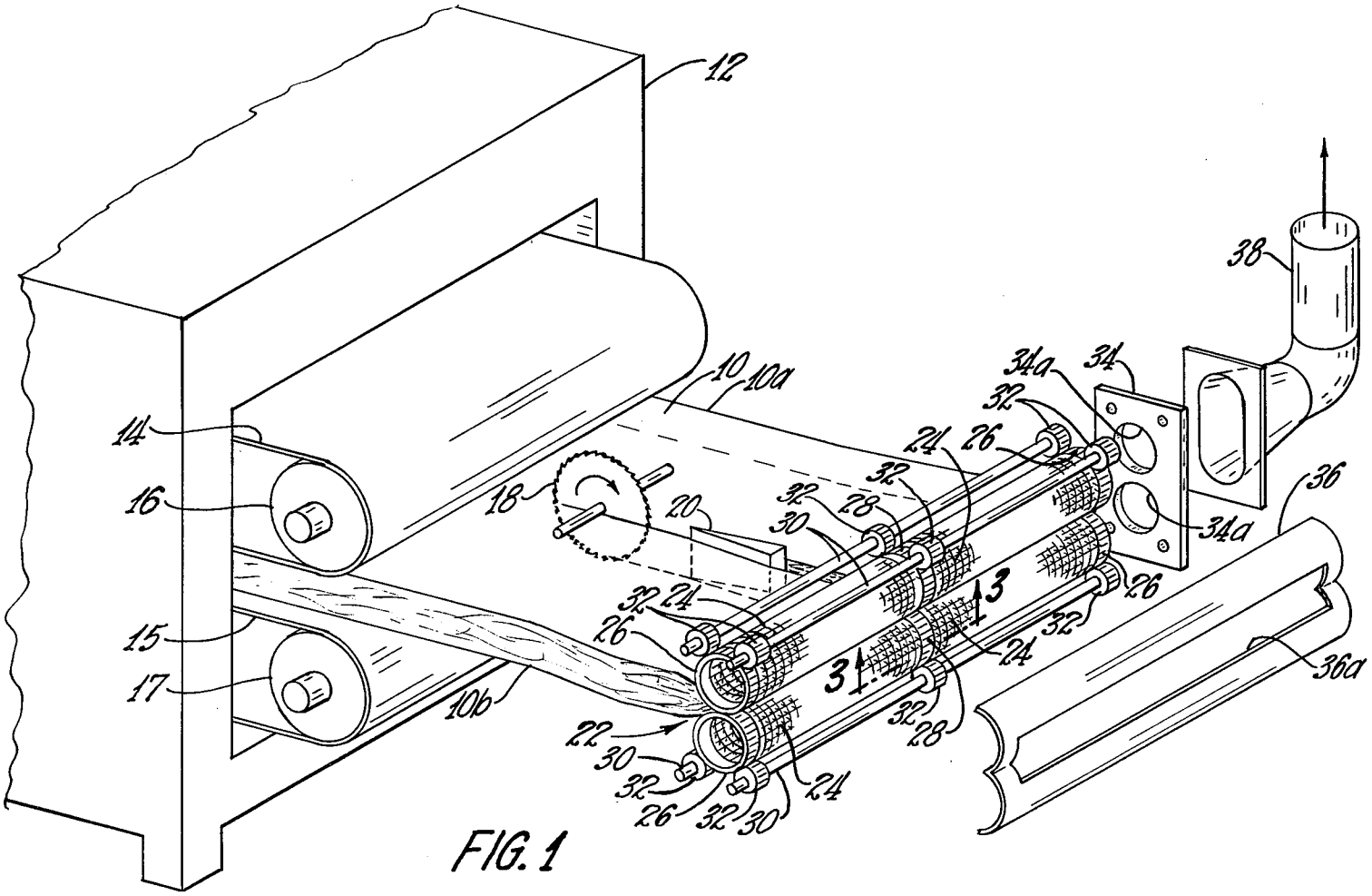
FIG. 1 is a fragmentary partially exploded perspective view of apparatus constructed in accordance with the invention.

With respect to the drawings, FIG. 1 shows a glass wool mat 10 emerging from a curing oven 12. The mat 10 is formed in a conventional manner by spinning fibers from molten glass, spraying the fibers with a binder, collecting the binder-coated fibers on a foraminous conveyor, and passing the fibers through the curing oven 12 to cure the binder and bond the fibers to each other. The thickness of the mat 10 is determined by the distance between a pair of endless conveyor belts 14 and 15 which travel respectively around oppositely driven rollers 16 and 17 to move the mat through the oven. As the mat 10 emerges from the oven, it is slit into two narrower mats **10*a* and 10*b* by a suitably driven circular saw 18. The mats 10*a* and 10*b* are separated by a wedge 20 downstream of the saw 18, and are then fed into cutting apparatus 22** constructed in accordance with the invention.

Figure 2:
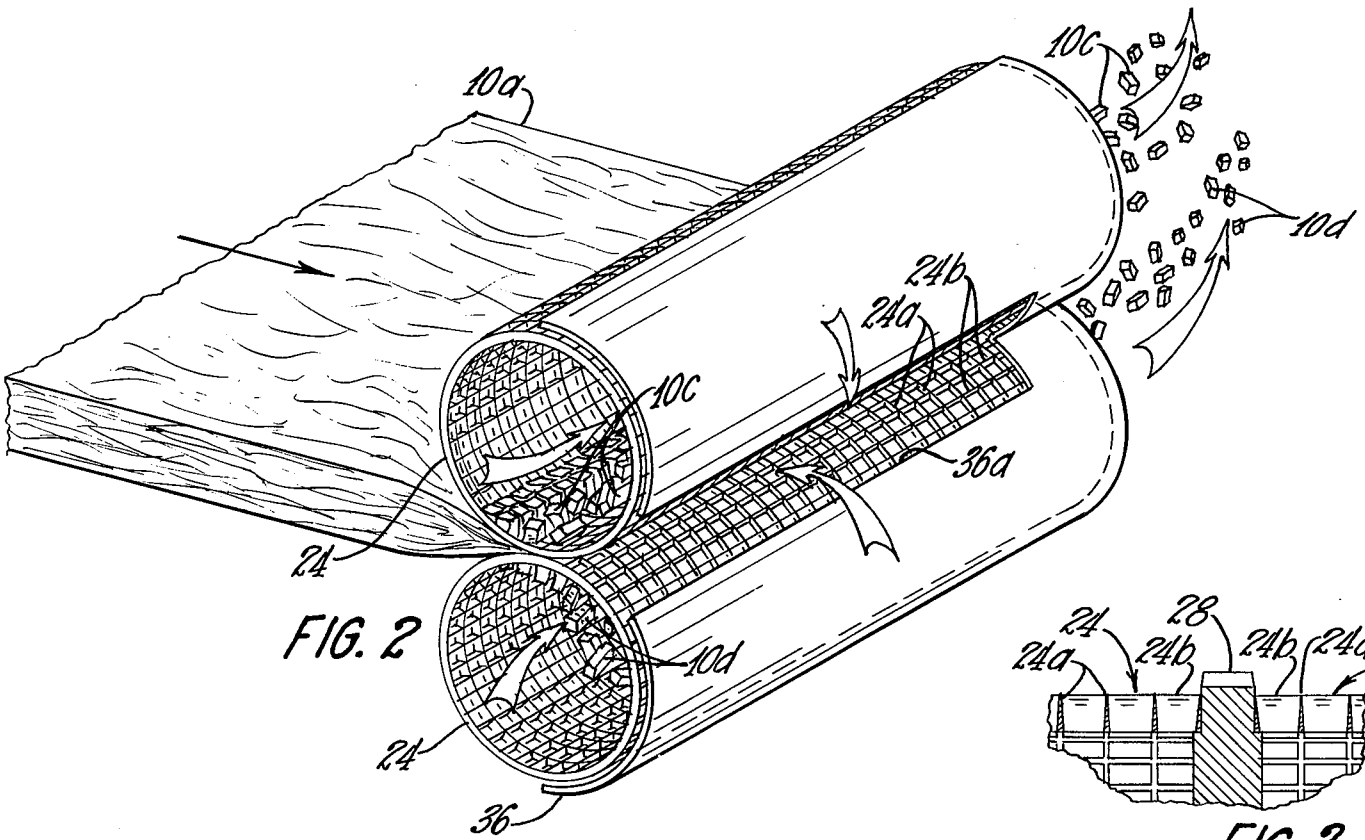
FIG. 2 is an enlarged perspective view of a portion of the apparatus of FIG. 1.
Figure 3:
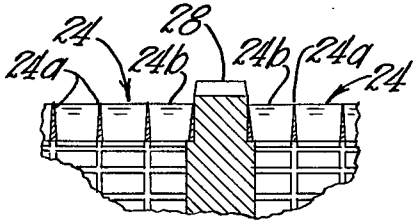
FIG. 3 is a fragmentary sectional view taken generally along the line 3—3 of FIG. 1.

The cutting apparatus 22 includes two pairs of gear-driven hollow cutting cylinders 24 each perforated with generally square holes as best shown in FIG. 2 to provide a grid of exterior cutting edges **24*a* and 24*b* extending respectively circumferentially and longitudinally of the cylinder. Each cutting cylinder 24 is fixedly secured in any suitable manner at its outer end to a hollow cylindrical gear 26 and at its inner end to a hollow cylindrical gear 28 common to two of the cutting cylinders 24. FIG. 3 shows two cutting cylinders 24 secured to a gear 28 by welds. Two upper shafts 30 centered in a horizontal plane are mounted above the axis of the upper cutting cylinders 24 and respectively on opposite sides of a vertical plane through the axis of the cylinders. Similarly, two lower shafts 30 centered in a horizontal plane are mounted below the axis of the lower cutting cylinders 24 and respectively on opposite sides of a vertical plane through the axis of the cylinders. Each shaft 30 is provided with three gears 32 respectively engaging the gears 26 and the common gear 28 of the adjacent pair of cutting cylinders 24. The four shafts 30 are mounted respectively at opposite ends in a pair of mounting plates 34 only one of which is shown. One of the shafts 30 is suitably driven to drive the respective gears 26 and 28 by the gears 32. A partial cover 36 provided with a slot 36*a* is mounted adjacent the cutting cylinders 24 on the opposite side thereof from the curing oven 12. Each plate 34 is provided with a pair of circular apertures 34*a* each aligned with the interior of the respective cutting cylinder 24 and of a diameter small enough so that the respective gear 26 is still confined by the plate 34. Ductwork 38 forming part of a pneumatic conveyor system is attached to each plate 34 in communication with the apertures 34*a* thereof. Suitable framework (not shown) is provided to support the plates 34 and the shafts 30 and cutting cylinders 24** mounted thereon.

If desired, the cylinders 24 may be made of separate arcuate sections. For example, three sections each with a subtended angle of one hundred twenty degrees could make up a cutting cylinder 24. Further, the sections or the complete cylinder 24 could be provided with unperforated end portions for welding or bolting to the respective gears 26 and 28.

A small clearance is permitted between each pair of upper and lower cutting cylinders 24. The separate glass fibers of the glass wool mat **10*a* or 10*b* are not actually cut all the way through by the cutting edges of the cylinders 24, but they break when the mat is pinched therebetween. Thus, the mat 10*a* or 10*b* is broken into small columns as it passes between the cutting cylinders 24. The glass wool mat 10 is originally formed in built-up layers of glass fibers extending mainly in horizontal planes. Therefore, each of the columns formed as the mat 10*a* or 10*b* passes between the cutting cylinders 24 readily breaks into two smaller columns 10*c* and 10*d* (FIG. 2), the columns 10*c* passing into the interior of the upper cutting cylinder 24 and the columns 10*d* passing into the interior of the lower cutting cylinder 24. A pneumatic conveyor system then conveys the columns 10*c* and 10*d* to a conventional bagging machine (not shown). The columns 10*c* and 10*d*,** due to their laminar structure, readily break up further at random into smaller glass fiber flakes and cubes during conveyance.

Various modifications may be made in the structure shown and described without departing from the spirit and scope of the invention. The pneumatic conveyor system represented by the ductwork 38 could operate off only one side of the production line so that the columns from both of the mats **10*a* and 10*b* would all be sucked one way through the cutting cylinders 24. While the holes in the cutting cylinders 24 are preferably square, they could be somewhat oblong and rectangular, and further, they could even be diamond shaped whereby cutting edges in the form of opposed helixes would be provided. It would also be within the scope of the invention to replace the lower cutting cylinders 24 with solid anvil rolls and let the entire cut columns pass into the interior of the upper cutting cylinders 24**.

I claim:

1. Apparatus for producing blowing wool insulation from glass wool mat comprising a pair of transversely adjacent open-ended shaftless elongated rotatable hollow cutting cylinders perforated with generally square holes to provide cylindrical grids each having exterior cutting edges extending respectively circumferentially and longitudinally of the cylinder, means for feeding glass wool mat between the cutting cylinders, a pair of open ring-shaped externally toothed shaftless gears fixedly secured respectively to opposite end portions of a first one of the cutting cylinders, a pair of open ring-shaped externally toothed shaftless gears fixedly secured respectively to opposite end portions of a second one of the cutting cylinders, the gears secured to the first one of the cutting cylinders being operatively engaged respectively with the gears secured to the second one of the cutting cylinders, a first pair of shafts parallel to the first cutting cylinder, disposed on the opposite side of a central rotational axis thereof from the second cutting cylinder, and respectively disposed on opposite sides of the central rotational axis of the first cutting cylinder, each shaft to the first pair having a pair of gears thereon operatively engaged respectively with the ring-shaped gears secured to the first cutting cylinder, a second pair of shafts parallel to the second cutting cylinder, disposed on the opposite side of a central rotational axis thereof from the first cutting cylinder, and respectively disposed on opposite sides of the central rotational axis of the second cutting cylinder, each shaft of the second pair having a pair of gears thereon operatively engaged respectively with the ring-shaped gears secured to the second cutting cylinder, means mounting the first and second pairs of shafts with the gears thereon to confine therebetween the shaftless cutting cylinders with the shaftless ring-shaped gears secured thereto, and means for removing cut glass wool mat from the interior of the cutting cylinders.

* * * * *